US008397417B2

(12) United States Patent
Jamison

(10) Patent No.: US 8,397,417 B2
(45) Date of Patent: Mar. 19, 2013

(54) VIBRATION DAMPING IN RIFLE CONSTRUCTION

(76) Inventor: John R. Jamison, Springfield, OR (US)

( * ) Notice: Subject to any disclaimer, the term of this patent is extended or adjusted under 35 U.S.C. 154(b) by 0 days.

(21) Appl. No.: 12/590,579

(22) Filed: Nov. 10, 2009

(65) Prior Publication Data

US 2010/0083551 A1 Apr. 8, 2010

Related U.S. Application Data

(63) Continuation-in-part of application No. 12/082,187, filed on Apr. 9, 2008.

(51) Int. Cl.
*F41C 23/18* (2006.01)

(52) U.S. Cl. ..... 42/75.03

(58) Field of Classification Search ..... 42/75.01, 42/75.03, 77

See application file for complete search history.

(56) References Cited

U.S. PATENT DOCUMENTS

| | | | | | |
|---|---|---|---|---|---|
| 36,014 | A * | 7/1862 | Meissner | 411/392 |
| 1,201,944 | A | 10/1916 | Dodds | |
| 1,828,287 | A | 10/1931 | MacBean | |
| 2,324,775 | A | 7/1943 | Hentschel | |
| 2,867,931 | A | 1/1959 | Schreiber | |
| 3,206,885 | A | 9/1965 | Dye | |
| 3,439,441 | A * | 4/1969 | Lawley | 42/75.01 |
| 3,763,855 | A | 10/1973 | McAtee | |
| 3,830,003 | A | 8/1974 | Clerke | |
| 4,312,146 | A | 1/1982 | Koon, Jr. | |
| 4,385,464 | A | 5/1983 | Casull | |
| 4,473,964 | A | 10/1984 | Straub et al. | |
| 4,864,761 | A | 9/1989 | Gregory | |
| 5,005,678 | A * | 4/1991 | Julien et al. | 188/378 |
| 5,123,194 | A | 6/1992 | Mason | |
| 5,247,758 | A | 9/1993 | Mason | |
| 5,423,145 | A | 6/1995 | Nasset | |
| 5,860,242 | A | 1/1999 | O'Neil | |
| 6,167,794 | B1 | 1/2001 | Kathe | |
| 6,233,458 | B1 | 5/2001 | Haumont et al. | |
| 6,487,805 | B1 | 12/2002 | Reynolds | |
| 6,637,142 | B1 | 10/2003 | Reynolds | |
| 6,684,547 | B2 | 2/2004 | Poff | |
| 6,889,462 | B1 | 5/2005 | Carlson | |
| 6,955,513 | B2 | 10/2005 | Niku | |
| 7,625,395 | B2 | 12/2009 | Muckter | |
| 2004/0058759 | A1 * | 3/2004 | Falone et al. | 473/568 |
| 2004/0243129 | A1 | 12/2004 | Moumene et al. | |

* cited by examiner

*Primary Examiner* — Michael Carone
*Assistant Examiner* — Reginald Tillman, Jr.
(74) *Attorney, Agent, or Firm* — Chernoff, Vilhauer, McClung & Stenzel LLP

(57) ABSTRACT

A rifle construction includes an action and barrel that seat within a stock. Vibration-damping material, such as a foam or gel, is interposed between at least portions of the stock and action that would normally be in contact with each other. The material may be secured to the stock or metal parts as adhesively backed strips or may be sprayed or extruded. The action is fastened to the stock with flexible fasteners that allow the action to seat properly and maintain alignment in the presence of recoil forces or other forces acting on the fasteners.

5 Claims, 4 Drawing Sheets

VIBRATION DAMPING IN RIFLE CONSTRUCTION

CROSS-REFERENCE TO RELATED APPLICATIONS

This application is a continuation-in-part of pending U.S. application Ser. No. 12/082,187 entitled Flexible Fasteners for Use in Rifle Construction, which was filed Apr. 9, 2008.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO SEQUENCE LISTING, A TABLE, OR A COMPUTER PROGRAM LISTING COMPACT DISC APPENDIX

Not applicable.

BACKGROUND OF THE INVENTION

Field of the Invention

Firearms, including rifles, have a barrel and an action that are coupled to a stock. The action is joined to the stock with screws that extend through the stock material and into holes in the action. The screws may also extend through a trigger guard plate so that when the three pieces are assembled the trigger guard plate or floor plate and the action sandwich the stock material in the middle. The action lies in a cutout portion of the stock. Typically, the action includes a recoil lug, which is a solid rectangular flange that fits within a slot that is cut into the stock material. When the action is dropped or pressed into the stock, the recoil lug seats in its slot and the pieces are held together by tension exerted from the screws as they are turned into the holes in the action. If there is any misalignment of the holes in the action, stock and/or floor plate, undesirable forces set up which are exerted on the fastener and, in turn, the action.

Typically, such fasteners are solid screws made of steel or some other solid, metallic material. The rigidity of these fasteners combined with stresses they may exert on the barreled action can lead to accuracy problems. First, unless the action and floor plate are seated perfectly and parallel with screw holes in perfect alignment, tightening the screws can set up undesirable forces and moments in the action/stock interface. Such adverse forces tend to release when the rifle is fired and cause the barreled action to shift or alter the action/stock relationship from shot to shot. These sometimes-imperceptible shifts in the action/stock relationship cause greatly magnified shifts in bullet dispersion on target down-range. Recoil forces act in a direction perpendicular to the longitudinal axes of the screws and usually above the shafts of the screws. Thus, it is difficult for the screws to hold the action and the stock together in a preferred alignment in the presence of such forces. Even small amounts of binding or cocking can have a negative effect on the accuracy of the firearm.

In the construction of firearms, the interface between the metal parts of the action and the wooden or plastic parts that form the stock is a critical region. When the firearm is discharged, the metal parts carry vibration from the chamber and barrel to the muzzle, which can cause greater shot dispersion on target. This vibration is transmitted to the stock and hence to the body of the user. Even if the firearm were held in a fixture of some sort, barrel and action vibration would have a negative impact on accuracy. Vibrations resulting from discharge can reinforce each other leading to even higher degrees of vibration. A rifle barrel that is attached to an action at the rear, which, in turn, is bolted to a stock, acts much like a tuning fork when fired. Anything that damps the amplitude and frequency of the vibration is beneficial insofar as reducing shot dispersion. Every point at which the action touches the stock is subject to the transmission of unwanted vibration, all of which affects the accuracy of the firearm. Metal and wood or plastic have different modes of vibration, and consequently the overall effect on the vibration pattern is difficult to predict or control. For example, the stock is secured to the action with screws at discrete points. Therefore, there are differences in the static forces that set up all along this interface when the screws are tightened and this too has an effect on the amount and type of vibration transmitted between stock and action.

In the past, numerous systems have been devised for detuning rifle barrels to prevent the discharge of the firearm from setting up vibrations that resonate in some part of the firearm, usually the barrel. The following patents have proposed solutions to this problem: Gregory (U.S. Pat. No. 4,864,761); Mason (U.S. Pat. No. 5,123,194); Mason (U.S. Pat. No. 5,247,758); Nasset (U.S. Pat. No. 5,423,145); O'Neil (U.S. Pat. No. 5,860,242); Kathe (U.S. Pat. No. 6,167,794); Schwinkendorf et al. (U.S. Pat. No. 6,223,458); Reynolds (U.S. Pat. No. 6,487,805); Poff, Jr. (U.S. Pat. No. 6,684,547); and Carlson (U.S. Pat. No. 6,889,462). These solutions do not address the vibration effects that exist at the interface between the action and the stock, or other metal parts.

BRIEF SUMMARY OF THE INVENTION

A rifle construction includes an action and barrel that seat within a stock. Vibration-damping material, such as a foam or gel, is interposed between at least portions of the stock and action and/or barrel that would normally be in contact with each other. The action may be fastened to the stock with fasteners that may flex in the presence of recoil forces or misalignment during manufacture and thus allow the action to seat properly and avoid cocking or binding.

The foregoing and other objectives, features, and advantages of the invention will be more readily understood upon consideration of the following detailed description of the invention, taken in conjunction with the accompanying drawings.

DETAILED DESCRIPTION OF PREFERRED EMBODIMENT

Figure 1:
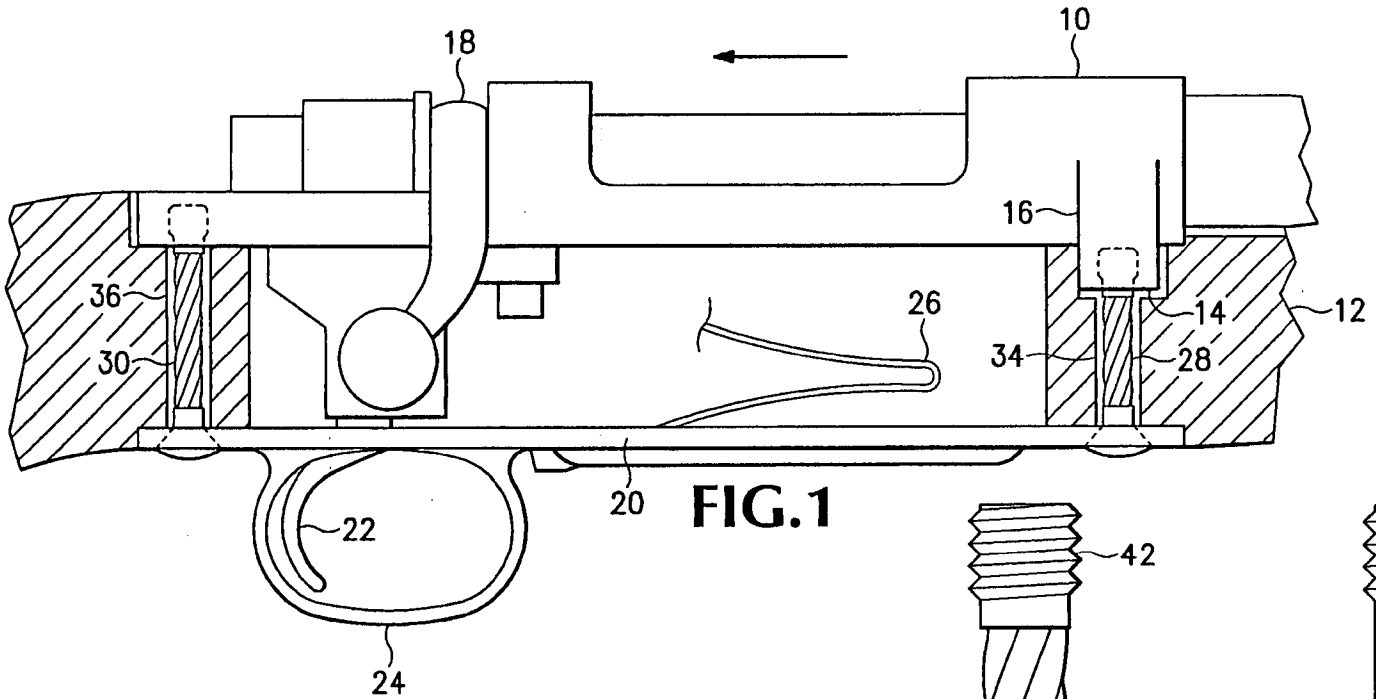
FIG. 1 is a partial side cutaway view of a firearm including an action and a stock and employing flexible fastening devices to couple the action to the stock.

A rifle construction as shown in FIG. 1 provides a way of coupling a standard action to a stock in a way that permits the action to seat properly without binding and without cocking. Further, recoil forces generated when the firearm is discharged do not throw the firearm out of alignment. Thus, a firearm that has been zeroed will remain in that condition because recoil forces will not affect the mechanical connection between the action and the stock, which sometimes happens with more conventional firearm constructions.

Referring to FIG. 1, an action 10 is seated within a stock 12. The stock 12 includes a slot 14, which accepts a recoil lug 16. Recoil forces are generally absorbed by the slot 14 that houses the recoil lug 16. Thus, there is always some movement in response to the recoil forces, which is generally in the direction of the arrow at the top of FIG. 1.

The action shown is a bolt-action type and, as such, includes a bolt 18. A trigger 22 extends through an opening (not shown) in the stock and is protected by a trigger guard 24. A second opening (also not shown) provides for the insertion of a magazine (not shown), which may be held in place by a floor plate 20. Other types of actions such as single shot, lever, semiautomatic or slide may be used as well.

The action 10 is coupled to the stock by a pair of fasteners 28 and 30. The fasteners 28 and 30 extend through holes in a floor plate or trigger guard plate 20, through respective holes 34, 36 in the stock, and into holes drilled in the action, which are adapted to accept threaded members.

Figure 2:
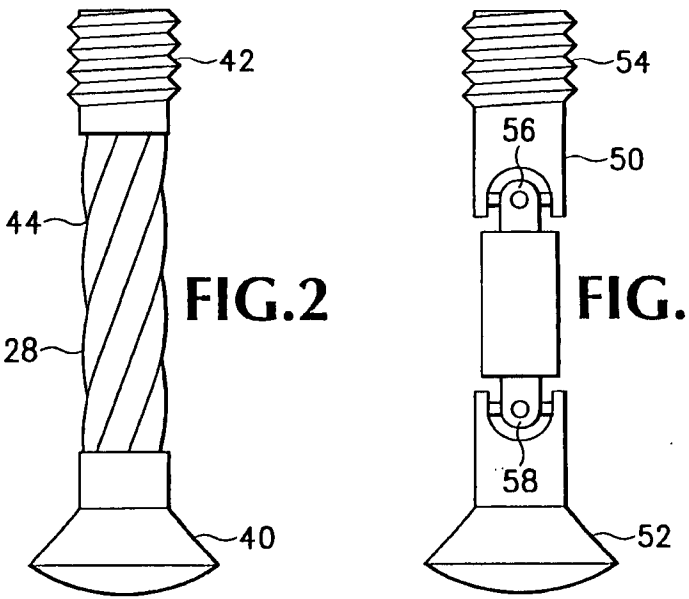
FIG. 2 is a side view of first type of flexible fastener.

Referring to FIG. 2, the fasteners are screw-type fasteners and, as such, include a head and a threaded distal end 42. A shank 44 is adapted to flex along its longitudinal axis, that is, the distal end 42 can move relative to the head 40 in all directions. Thus, the shank 44 can flex in a direction that is substantially parallel to the direction of recoil forces as indicated by the arrow in FIG. 1 as well as in other directions. The shank 44 of the fastener 28 can also flex in response to forces that are set up within the interface between the action 10 and the stock 12, whether caused by recoil, by initial seating of the action with respect to the stock, or by expansion and contraction of materials in response to temperature changes. It will be appreciated that the shank can flex in any direction along its axis, which allows for less than precise seating of the action to the stock and the floor plate without any adverse effect on the zero of the firearm.

Figure 3:
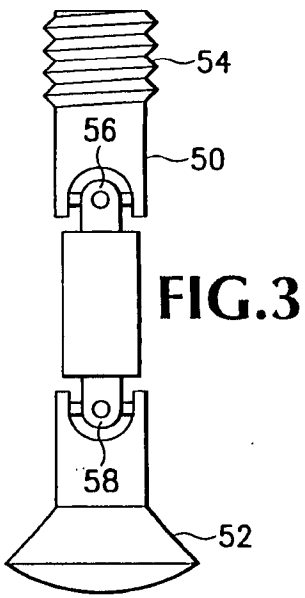
FIG. 3 is a side view of a second type of flexible fastener.

Referring to FIG. 3, a second type of fastener 50 includes a head 52 and a distal threaded end 54. The shank of fastener 50 is made of a solid material but includes U-joints 56 and 58, which permit omnidirectional flexing.

The fasteners 28 and 30 are aligned so as to lie approximately along a line parallel to the bore axis of the barrel of the firearm. This means that all recoil forces will be acting substantially perpendicular to the fasteners 28 and 30 without setting up any extraneous angular moments because the fasteners have shanks that will flex in response to recoil forces. This is ideal; however, even if alignment is not perfect, the fact that the fasteners may flex avoids inaccuracies that would otherwise set up in the action/stock interface as is the case with rigid, nonbendable fasteners.

The stock 12 has holes 34 and 36 to permit passage of the fasteners from the trigger guard plate 20 into the action 10. The holes 34 and 36 are made so as to be oversized with respect to the respective diameters of the shanks of the fasteners 28 and 30. In this way, the fasteners 28 and 30 can flex within these holes in response to forces generated by recoil or otherwise without bearing against the stock material and causing the action to become skewed with respect to the stock or be thrown out of alignment.

The shank 44 of the fastener 28 is constructed from a bundle of wires wound in a helical fashion and the bundle is constrained at either end by the head 40 and the distal end 42 respectively. Such a construction is sometimes referred to as "wire rope" and consists of filaments of metal wire wound about an axis. Other types of constructions may be used for the shank portion of the fasteners 28 and 30 and the invention is not limited to the two types of construction shown in FIGS. 2 and 3. Any type of strong yet flexible material that permits the flexing of the shank in response to forces generated in directions generally perpendicular to the shank will work for the purposes described above.

The accuracy of a firearm can also be greatly improved by providing damping material at the interface between the metal parts of a rifle, such as the action, and the stock. Such material may take several forms. In its simplest form, a gasket made of a polyurethane foam may be provided between parts of the action and stock that are normally in contact with each other. Alternatively, strips of such material may be glued to the stock along areas where the action rests against the stock. In another alternative, washers made of damping material may be used around the screws that hold the stock and the action together. The damping material can take many different forms and availability, ease of manufacture and cost may dictate the choice of material. However, the material must be resilient enough to absorb vibration of the type generated by the discharge of a firearm. A good example of such material is Sorbothane®, which is gel-like material that may be molded to a selected shape. Polyurethane foam in strips or sheets may be cut and glued to the stock. Sorbothane® is a thermoset, polyether-based, polyurethane material. In addition to being visco-elastic, Sorbothane® also has a very high damping coefficient. It combines shock absorption, good memory, vibration isolation and vibration damping characteristics combined with a long fatigue life.

Sorbothane® has a superior damping coefficient, over a very wide temperature range, compared to any other polymer. The operating temperature range of Sorbothane® is −20° to +160° Fahrenheit (−29° to 72° Celsius). Another material is a silicone gel tape. This tape has a back cover layer that may be peeled away to expose an adhesive-backed layer. The tape may be cut to the desired shape before peeling away the cover layer and the material so cut may then be pressed onto portions of the upper surfaces of the stock that would normally be in contact with the action or barrel. Other types of damping materials include spray-on foams and gels extruded from tubes like caulking.

Figure 4A:
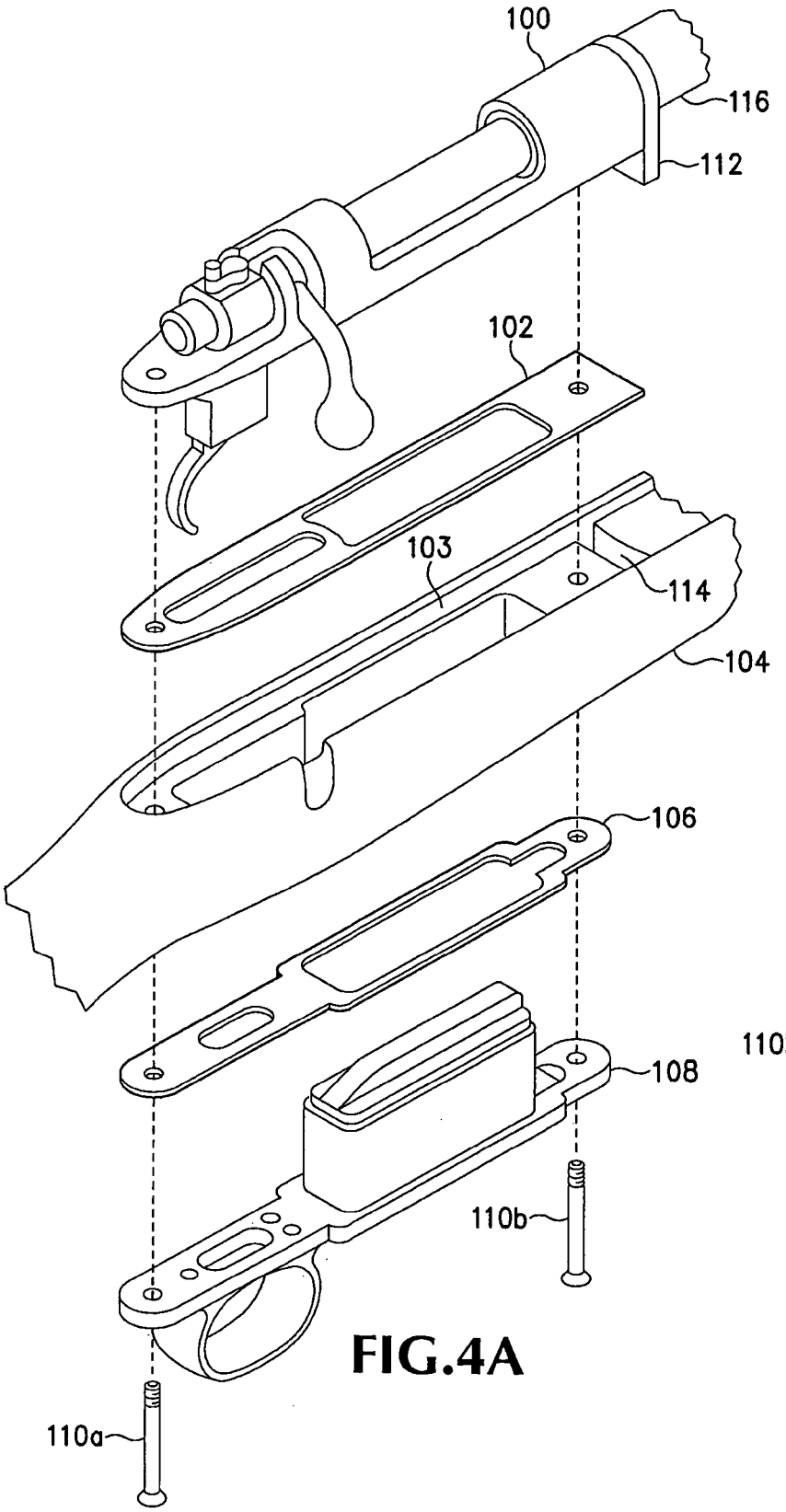
FIG. 4A is a partial exploded perspective view of an action, a stock, and a trigger guard plate with vibration-damping gaskets interposed between metallic and wooden parts.

Referring to FIG. 4A, an action 100 rests in a cutout portion 103 of a stock 104. A barrel 116 is joined to the action with a recoil lug 112 acting as a washer. The lug 112 rests in a slot 114. A gasket formed from damping material 102 may be inserted into the cutout portion 103 of the stock 104. Thus, the gasket 102 provides an interface between metal parts of the action 100 and the wooden stock 104. Similarly, a gasket 106, also made from a vibration-damping material, may be interposed between a trigger guard plate 108 and the stock 104. The action 100, the stock 104 and the trigger guard plate 108 are joined together by screws or bolts 110*a* and 110*b*.

Figure 4B:
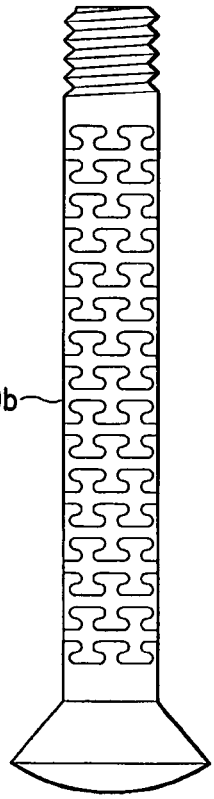
FIG. 4B is an alternative type of flexible fastener.

As shown in FIG. 4B, the screw 110*b* is a flexible screw made of segmented metal pieces, which allow the screw to flex in its longitudinal direction. Fasteners of this type are available from Nemcomed, Inc. at www.nemcomed.com under the trade name "Flex-Shaft."

Figure 5:
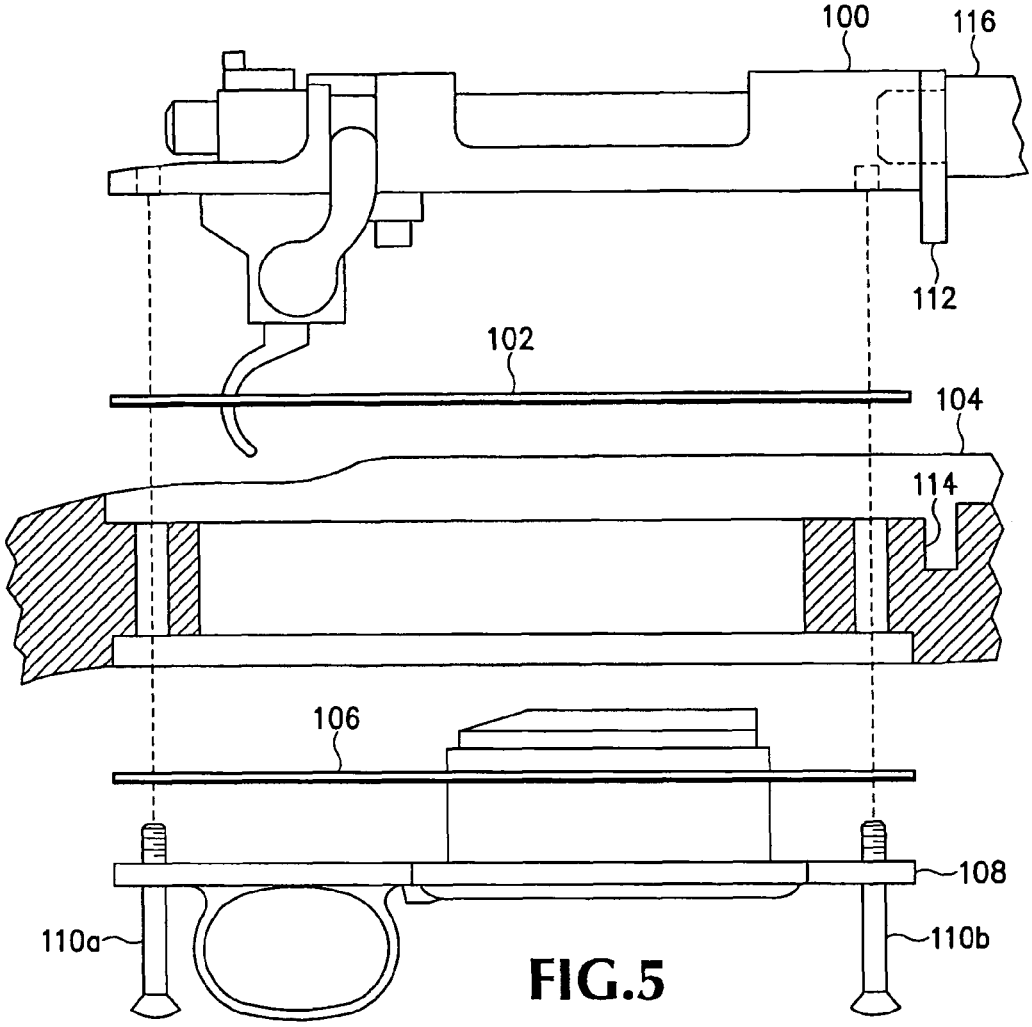
FIG. 5 is an exploded side elevation view of the apparatus of FIG. 4A.
Figure 6:
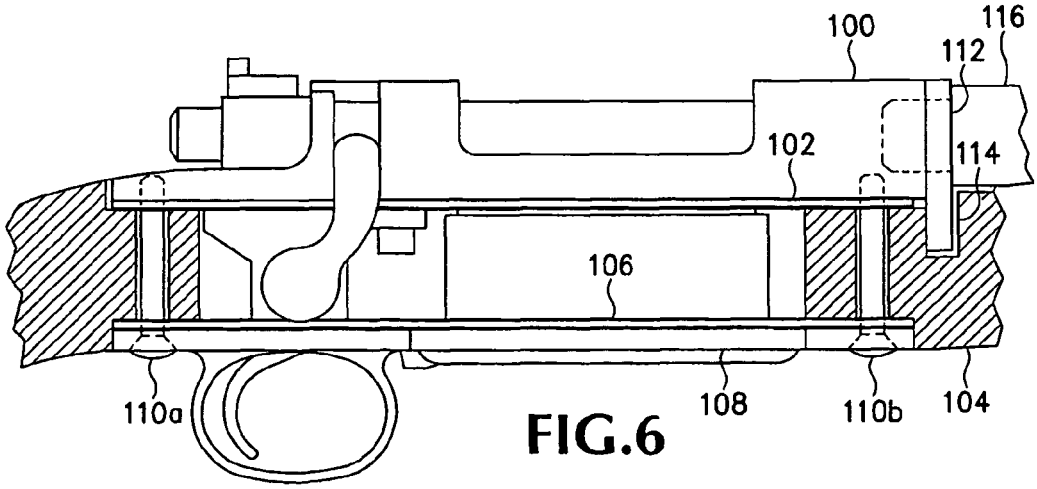
FIG. 6 is a side elevation view of the apparatus of FIG. 5 with parts fastened together.

FIG. 5 shows the combination of FIG. 4A in a side exploded view and FIG. 6 shows the combination in which screws 110*a* and 110*b* have coupled the trigger guard plate 108 and the action 100 to the stock 104.

Figure 7:
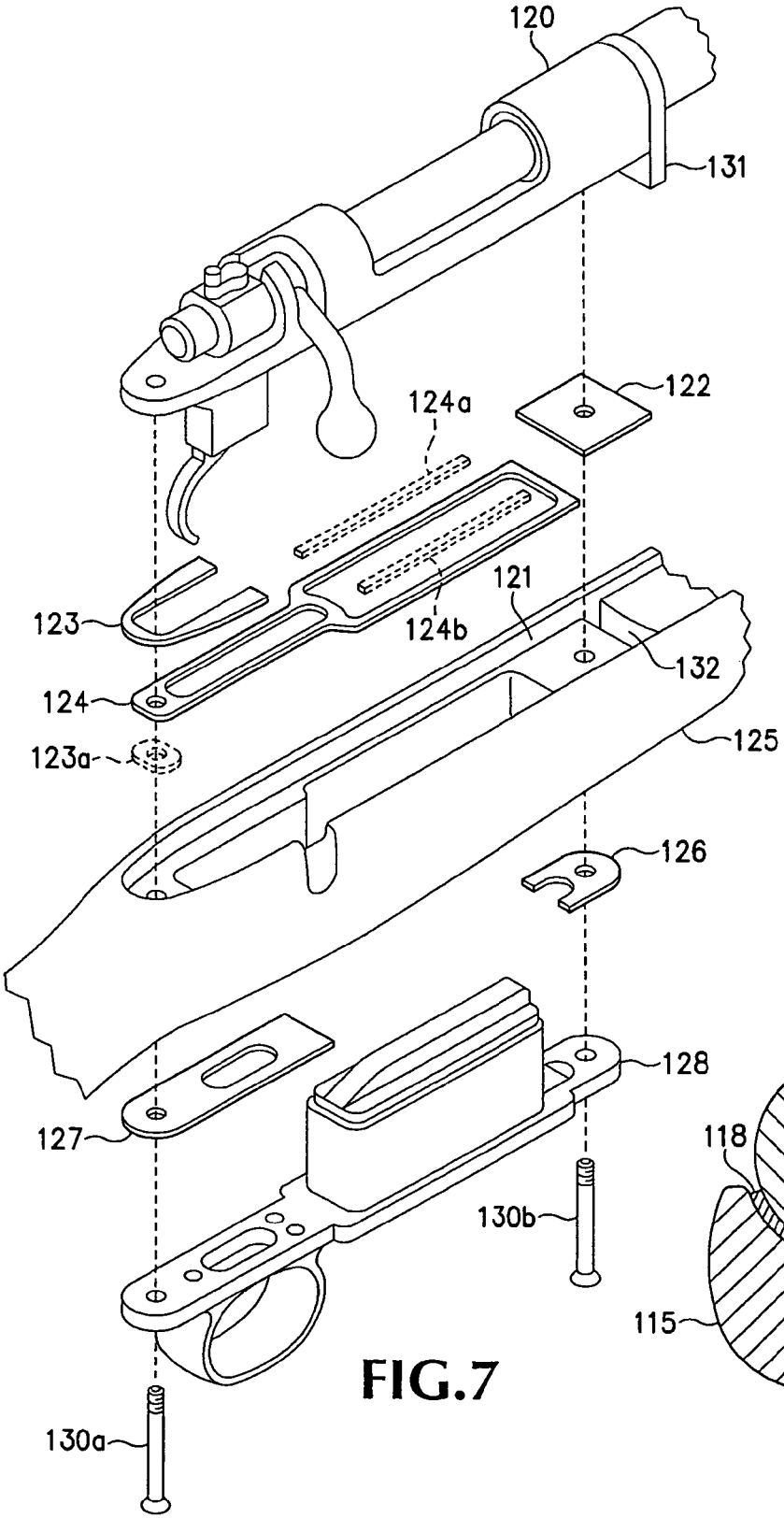
FIG. 7 is a partial exploded perspective view of an action, a stock and a trigger guard plate with segmented vibration-damping materials interposed between the metal and wooden rifle parts.

FIG. 7 shows a different embodiment in which the vibration-damping material is not formed as a gasket, but is cut to form discrete pieces of vibration-damping material, which may be used at selective locations as chosen by the user. An action 120 is coupled to a stock 125. Segments of damping material 122, 123 and/or 124 may be inserted into the cutout portion 121 of the stock 125 as desired by the user. Not all of the segments 122, 123 and 124 must be used. For example, the user could decide to use only segments 122 and 123. Another possible embodiment is shown by reference to the dashed outline in FIG. 7. Segments of vibration-damping material 124*a* and 124*b* may be interposed into the cutout portion 121 of the stock 125 in combination with segment 122 and segment 123. A different possibility would be to use the damping material cut in the form of a washer 123*a* instead of either segment 124 or 123. Using a combination of segments, such as washer 123*a*, segment 122 and segments 124*a* and 124*b*, will leave gaps in the interface between the metal of the action 120 and the stock 125. Such gaps do not pose a significant problem in terms of vibration damping, but it may be easier to form strips of material and washers than to form a gasket. A gasket requires specific knowledge of the dimensions of the rifle parts involved whereas elongate strips and washers may be used for a variety of firearms.

A trigger guard plate 128 is coupled to the stock 125 by flexible screws 130*a* and 130*b*. Segments of vibration-damping material 127 and 126 may be interposed between the trigger guard plate 128 and the stock 125. The flexible screws 130*a* and 130*b* may be of any of the forms mentioned above including but not limited to the Flex-Shaft screw of FIG. 4B.

Figure 8:
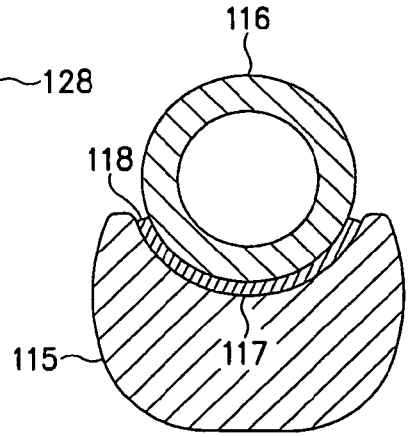
FIG. 8 is an end sectional view of the firearm of FIG. 1 showing the barrel resting in a yoke formed by the stock with damping material interposed.

Vibration of the barrel may be effectively damped by inserting damping material between the barrel and the stock. This is shown in FIG. 8 in which the barrel 116 rests in a forward yoke 117 formed in the stock 115. The damping material 118 is interposed between the barrel 116 and the stock 115 at the portion of the stock that would normally be in contact with and support the barrel By assembling the metal and wooden parts of a rifle using both flexible screws and vibration-damping material between the metal and wooden parts, major inaccuracies caused by recoil forces and vibration may be significantly attenuated.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. In a rifle construction comprising a stock and an action, the stock adapted to be joined to the action by screw-type fasteners, the action having a lower metal surface and the stock having an upper non-metal surface, the improvement comprising solid strips or pads of resilient material having an adhesive backing for securing said strips or pads to selected portions of the upper surface of said stock, said strips or pads providing a resilient mating interface between said action and said stock wherein said pads or strips are spaced apart from each other on said upper surface leaving gaps therebetween such that voids are created between the stock and the action; and wherein said screw-type fasteners each have a head, a distal end and a shank, the shanks being constructed so as to permit the fasteners to flex in directions normal to said shank in response to forces acting in directions normal to said shank so as to permit the action to seat in the stock without binding or cocking.

2. The rifle construction of claim 1 wherein said stock has holes for receiving said screw-type fasteners, said holes being oversized so as to allow lateral flexing therein of said shanks of said screw-type fasteners.

3. In a rifle construction comprising a stock and an action, the stock adapted to be joined to the action by screw-type fasteners, the action having a lower metal surface and the stock having an upper non-metal surface, the improvement comprising strips or pads of resilient material secured to the upper surface of said stock, said strips or pads providing a resilient mating interface between said action and said stock, said screw-type fasteners having a head, a threaded distal end and a shank, the shank having a construction which permits flexing in all directions normal to said shank thereby allowing the action to seat in the stock without binding or cocking.

4. The rifle construction of claim 3 wherein said pads or strips are spaced apart from each other on said upper surface leaving gaps therebetween such that voids are created between the stock and the action.

5. The rifle construction of claim 3 wherein said stock has holes for receiving said screw-type fasteners, said holes being oversized so as to allow lateral movement therein of said shanks of said screw-type fasteners.

* * * * *